US006062621A

United States Patent [19]

Zelazny

[11] Patent Number: 6,062,621

[45] Date of Patent: May 16, 2000

[54] COLLAPSIBLE GRAPPLING HOOK

[76] Inventor: Mark Zelazny, 13161 Foley Rd., Emmet, Mich. 48022

[21] Appl. No.: 09/177,088

[22] Filed: Oct. 21, 1998

[51] Int. Cl.[7] ..... B66C 1/10

[52] U.S. Cl. ..... 294/82.1; 294/1.1

[58] Field of Search ..... 294/1.1, 66.1, 294/66.2, 82.1, 82.11; 114/294, 297–299, 301–305, 307

[56] References Cited

U.S. PATENT DOCUMENTS

| | | | |
|---|---|---|---|
| 721,663 | 3/1903 | Brooke | 114/304 |
| 1,978,844 | 10/1934 | McLeland | 114/305 |
| 2,796,844 | 6/1957 | March | 114/299 |
| 3,092,412 | 6/1963 | Drake | 294/82.1 |
| 4,108,484 | 8/1978 | Malroit . | |
| 4,145,835 | 3/1979 | Snow | 294/66.1 |
| 4,297,963 | 11/1981 | Beacom | 294/82.1 |
| 4,596,202 | 6/1986 | Brewster . | |
| 5,092,261 | 3/1992 | Bertrand | 114/304 |
| 5,388,877 | 2/1995 | Wenk . | |
| 5,613,721 | 3/1997 | Mullins . | |

*Primary Examiner*—Dean J. Kramer
*Attorney, Agent, or Firm*—Mick A. Nylander

[57] ABSTRACT

A collapsible grappling hook comprising a shaft having a first end and a second end and a raised shoulder portion located between the first end and the second end a spring having a first end and a second end, the spring attached to the shaft such that the first end contacts the raised shoulder portion, a fixed grapple attached to the shaft including at least one extending fluke and a movable grapple slidable attached to the shaft between the fixed grapple and the raised shoulder, the movable grapple including at least one extending fluke, wherein the movable grapple is movable from a collapsed position such that the movable grapple is generally parallel to the to fixed grapple to an open position such that the movable grapple is generally perpendicular to the fixed grapple whereby the spring applies a sufficient force from the second end of the spring to the movable grapple to lock the grapple in the open position.

6 Claims, 4 Drawing Sheets

COLLAPSIBLE GRAPPLING HOOK

TECHNICAL FIELD

The present invention relates to a collapsible grappling hook and more particularly, to a collapsible grappling hook for use as a hunting aid in assisting in retrieving fallen articles while a hunter is located in a tree or other elevated location.

BACKGROUND ART

Elevated platform hunting is a popular and growing sport throughout the country and the world. It is known that certain advantages are provided to the hunter if the hunter is located in a tree. Target angles are more advantageous if the hunter is located high up in a tree from 10 feet to 15 feet above the ground. In addition to advantageous target angles, various natural obstructions are removed when the hunter is located above the ground. For these reasons, it is common for hunters in many different jurisdictions, to hunt in tree stands above the ground.

Tree stands are normally positioned, as stated, from 10 to 15 feet above the ground. Often the hunter lifts numerous articles up into the tree such as, articles of clothing, rain gear, bows, arrows, food containers, coolers, equipment belt, back pack and various tree stand compatible seating arrangements. In climbing and once up in the tree stand, inadvertent movements may cause some or all of these carried articles to fall to the ground. Hunters often do not desire to climb back to the ground to retrieve these fallen articles. At that point a convenient, cost effective and easily transportable tool is required to assist the hunter in retrieving fallen articles. In addition and effective method for lowering articles from a tree stand is also desirable.

U.S. Pat. No. 5,388,877 to Wenk discloses a hunting bow retriever which is releasably engagable with a hunting bow to allow a treebound hunter to raise and lower the hunting bow to the hunting position. The hunting bow retriever comprises a reel mounted in an enclosed palm sized casing and a line wound on the reel and extending out of the casing. The line has an open hook on the end that permits remote release of the bow. A foldable handle assembly engages the reel and implements rotational movement. The hunting bow retriever of Wenk discloses a hook 32 which is not designed for use in retrieving fallen articles but is directed at raising and lowering articles that have had the hook 32 attached prior to raising or lowering. Thus the hunting bow retriever of Wenk is not useful in solving the above described problems associated with fallen article retrieval.

U.S. Pat. No. 5,613,721 to Mullins discloses an apparatus for raising, lowering and retrieving an article such as an arrow or an article of clothing to and from an elevated position relative to the ground such as a tree stand. The article retrieving apparatus of the Mullins patent includes a foldable hook assembly with a pair of spaced apart generally parallel body members defining a space there between adapted to receive an arrow, spacers arranged between the body members and a pair of fork arms pivotally connected with the body members. The fork arms are provided with angled surfaces which facilitate engagement of the item and allow the apparatus to slide along the ground. The ends of the fork arms are provided with barbs which allow soft articles, such as articles of clothing to be engaged.

The article retrieving apparatus of Mullins includes a two piece moving or pivoting system which must operate flawlessly each time it is dropped or lowered to the ground to raise the fallen articles. A simpler, more consistent means of retrieval is desirable. In addition the closely arranged forks 28 and 30 do not allow for a broad range or area for which an article can be initially engaged before raising the article. A larger area of engagement of the forks is important in light of the sometimes limited mobility of the hunter while located in the elevated tree stand.

U.S. Pat. No. 4,596,202 to Brewster discloses collapsible boat anchor comprising a fixed grapple and a movable grapple. The fixed grapple includes a shaft having the movable grapple located thereon. The shaft includes a releasable lock adapted to unlock the movable grapple so that it lies parallel to the fixed grapple allowing storage of the anchor. The lock, in its locked position, locks the movable grapple in a fixed position whereby it extends transverse to the fixed grapple allowing the grapples to act as an anchor.

U.S. Pat. No. 4,108,484 to Malroit discloses a collapsible grapple comprising a pair of selectively assembleable members. The first member includes a pair of elongated shanks confluent at their upper ends to form a single part and defining between them an elongate slot. The second member similarly comprises a pair of elongated shank confluent at their upper ends to form a single part and defining between them an elongate slot. The shank elements of the second member converge below their upper ends to form a first loop, then part and converge again below the first loop to form a second loop between the first and second convergences. The lower ends of the shanks of both members extend away from the elongated slot and have pointed ends to define a pair of hooks lying in substantially the same plane as the shanks.

SUMMARY OF THE INVENTION

A primary object of the present invention is to provide a collapsible grappling hook which is easily and accurately maneuvered to engage a fallen article such that it can be raised or lowered relative to an elevated position.

Yet, still another object of the present invention is to provide a collapsible grappling hook which is compact, durable, easy to use and store.

A further object of the present invention is to provide a collapsible grappling hook which is inexpensive to mass produce.

A further object of the present invention is to provide a collapsible grappling hook which is collapsible or foldable to such an extent that it can easily be placed in a pocket and not interfere with the climbing needs of a hunter.

A more specific object of the present invention is to provide a collapsible grappling hook comprising a shaft having a first end and a second end and a raised shoulder portion located between the first end and the second end a spring having a first end and a second end, the spring attached to the shaft such that the first end contacts the raised shoulder portion, a fixed grapple attached to the shaft including at least one extending fluke and a movable grapple slidable attached to the shaft between the fixed grapple and the raised shoulder, the movable grapple including at least one extending fluke, wherein the movable grapple is movable from a collapsed position such that the movable grapple is generally parallel to the to fixed grapple to an open position such that the movable grapple is generally perpendicular to the fixed grapple whereby the spring applies a sufficient force from the second end of the spring to the movable grapple to lock the grapple in the open position.

Another specific object of the present invention is to provide a fixed grapple having an outer side and an inner side, the inner side having a pair of spaced apart raised nubs extending out from inner side toward the movable grapple such that the movable grapple is located between the raised nubs when the movable grapple is in the open position.

Still another object of the present invention is to provide a collapsible grappling hook having a fixed grapple defining a hole for receiving the shaft, the movable grapple also defines a hole for receiving the shaft and the spring is attached to the shaft such that the shaft extends through the shaft whereby the fixed grapple, movable grapple and spring are all coaxially aligned on the shaft.

Yet still another object of the present invention is to provide a collapsible grappling hook having an adjustable nut located on the threaded portion of the shaft to allow for force on the movable grapple to be adjusted.

A still further object of the present invention is to provide a collapsible grappling hook comprising a shaft having a first end and a second end and a raised shoulder portion located between the first end and the second end, a spring having a first end and a second end, the spring attached to the shaft such that the first end contacts the raised shoulder portion, a fixed grapple attached to the shaft including a pair of oppositely extending flukes, a movable grapple slidable attached to the shaft between the fixed grapple and the raised shoulder, the movable grapple including including a pair of oppositely extending flukes, wherein the movable grapple is movable from a collapsed position such that the movable grapple is generally parallel to the to fixed grapple to an open position such that the movable grapple is moved at least 45 degrees apart from and in relation to the fixed grapple whereby the spring applies a sufficient force from the second end of the spring to the movable grapple to lock the grapple in the open position and attachment means for attaching the shaft to a cord for use in raising or lowering the collapsible grappling hook.

BEST MODE FOR CARRYING OUT THE INVENTION

Figure 1:
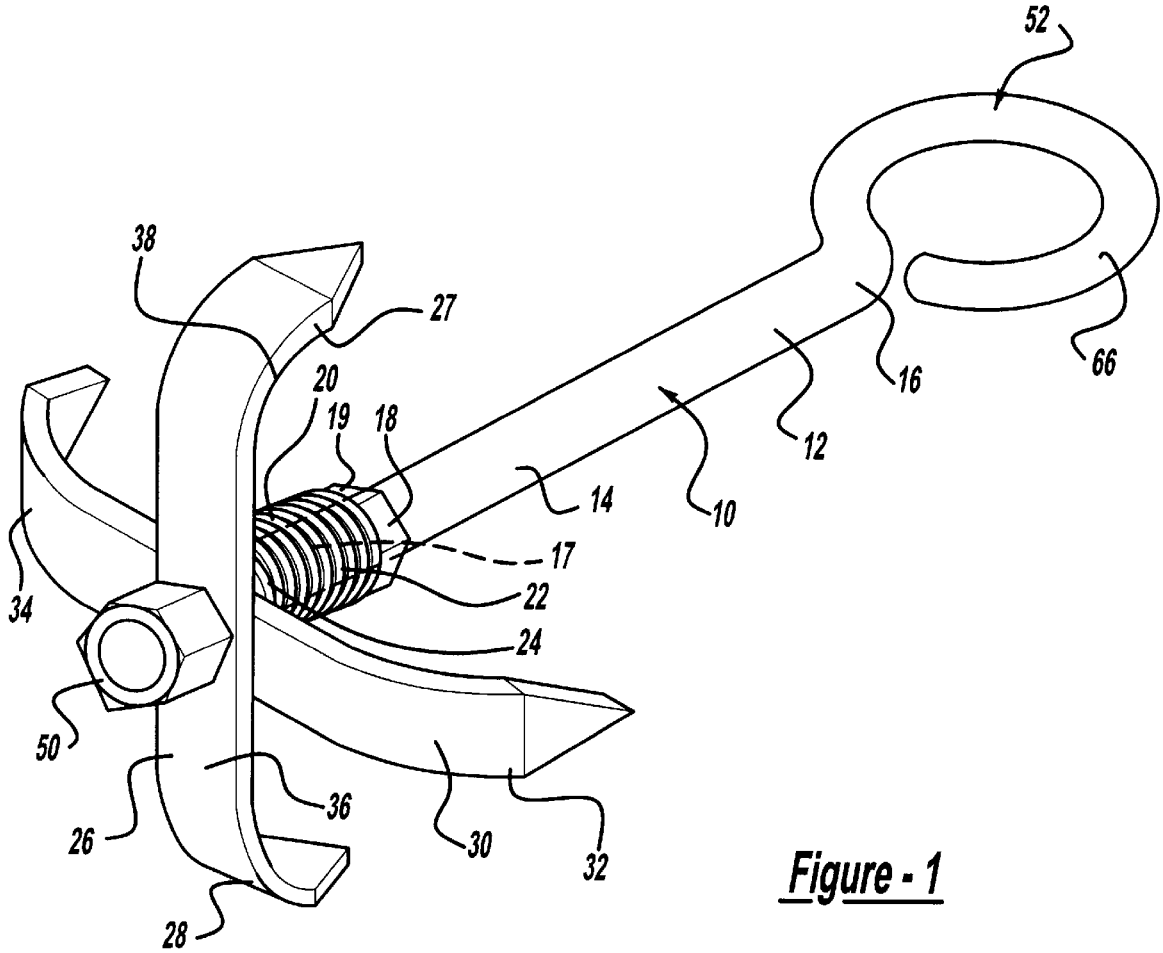
FIG. 1 is an environmental view of the collapsible grappling hook of the present invention.
Figure 2:
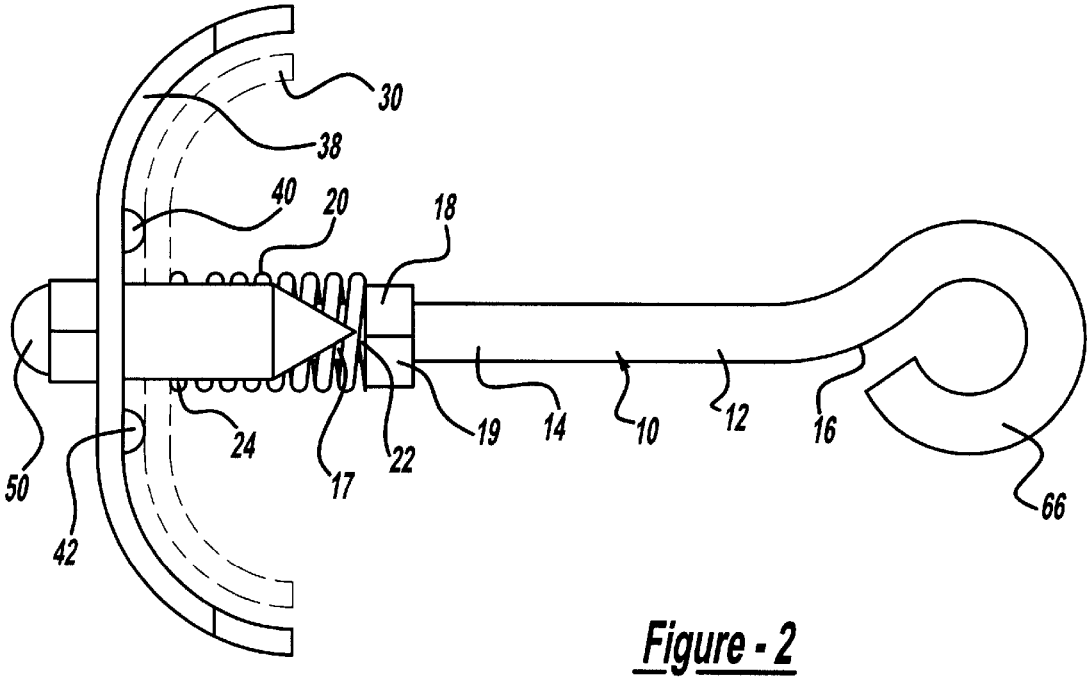
FIG. 2 is a side view of the collapsible grappling hook of the present invention.
Figure 3:
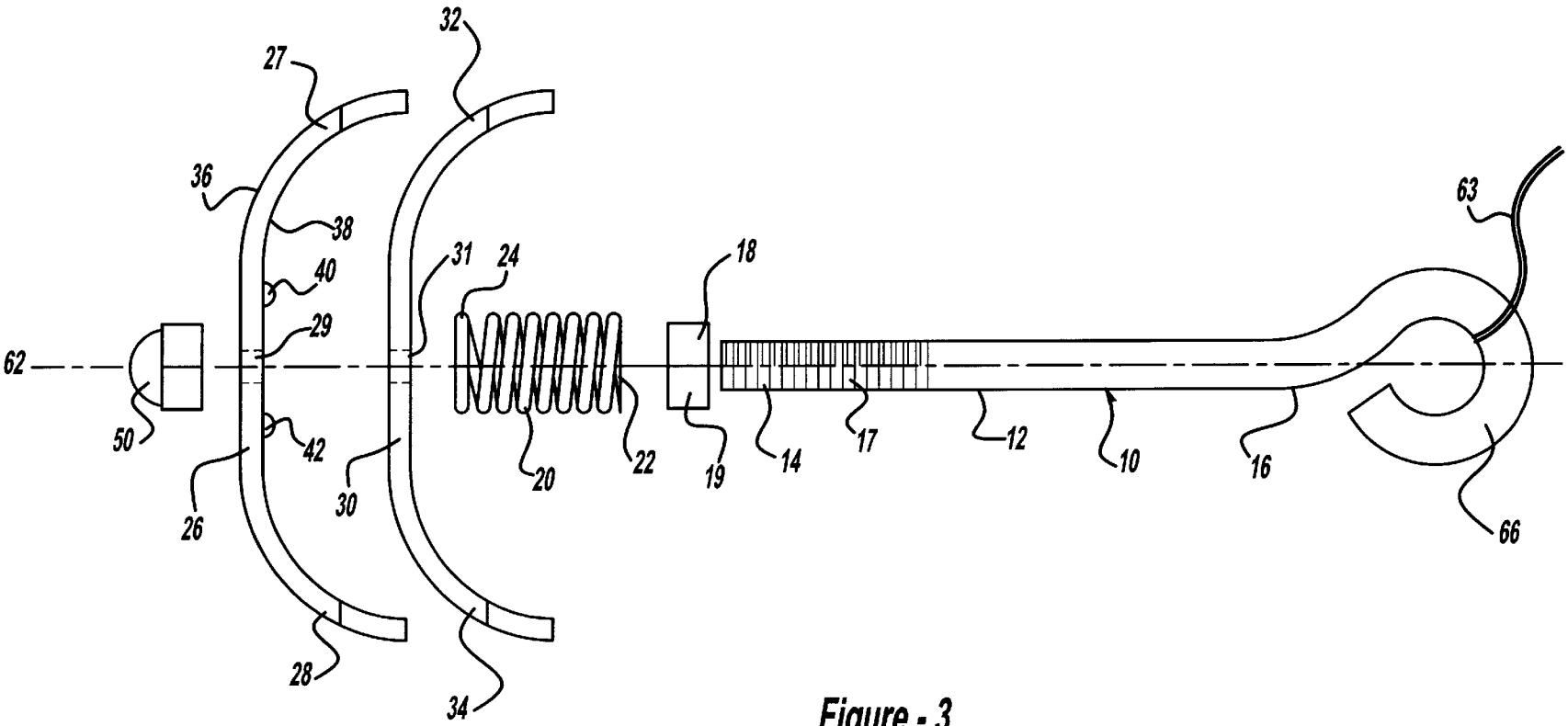
FIG. 3 is an exploded side view of the collapsible grappling hook of the present invention.

Referring now to FIGS. 1–3, there is shown generally, a collapsible grappling hook 10. Collapsible hook 10 includes a shaft 12 having a first end 14 and a second 16. In the preferred embodiment, the first end 14 has a threaded portion 17. Shaft 12 further includes a raised shoulder 18. In the preferred embodiment of the present invention, the raised shoulder is a nut 19. Nut 19 is threaded onto threaded portion 17 of shaft 12 as shown in FIGS. 1 and 2. Spring 20 is placed onto shaft 12 such that first end 22 of spring 20 contacts nut 19.

Fixed grapple 26 is affixed to shaft 12 in any fashion wherein fixed grapple 26 is prevented from rotating freely about the shaft 12. In the preferred embodiment, fixed grapple 26 has a hole 29 as shown in FIG. 3 such that shaft 12 passes through hole 29 as shown in FIGS. 1 and 2 and is welded to shaft 12. Fixed grapple 26 has a outside surface 36 and an inside surface 38 . Fixed grapple 26 also includes a pair of raised nubs 40 and 42. Fixed grapple 26 has a pair of flukes 27 and 28 which extend out away from hole 29 in substantially opposite directions. Movable grapple 30 is also placed onto shaft 12 as shown in FIGS. 1–3. End nut 50 is screwed onto the threaded portion 17 of shaft 12. Movable grapple 30 has a hole 31 as shown in FIG. 3 such that shaft 12 passes through hole 31 as shown in FIGS. 1 and 2. Movable grapple 30 has a pair of flukes 32 and 34 which extend out away from hole 31 in substantially opposite directions. As in FIG. 3, shaft 12 extends through hole 29 and 31 whereby fixed grapple 26, movable grapple 30 and spring 20 are all coaxially aligned on shaft 12.

Figure 4:
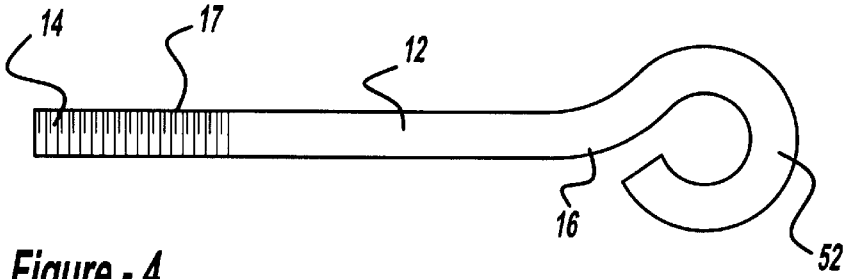
FIG. 4 is a side view of the shaft of the present invention.
Figure 5:
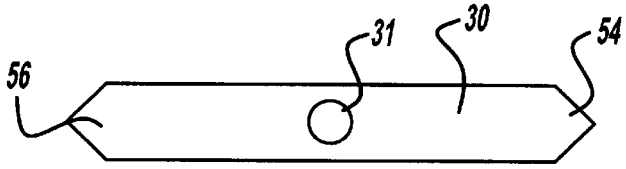
FIG. 5 is a top view of the movable grapple of the present invention.
Figure 6A:
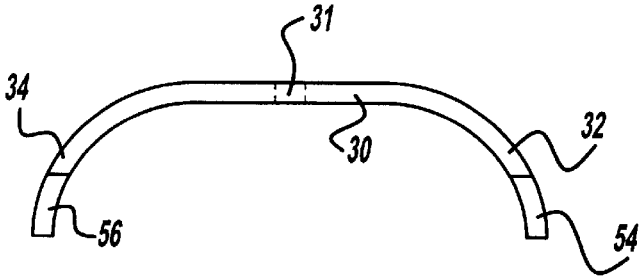
FIG. 6A is a side view of the movable grapple of the present invention.
Figure 6B:
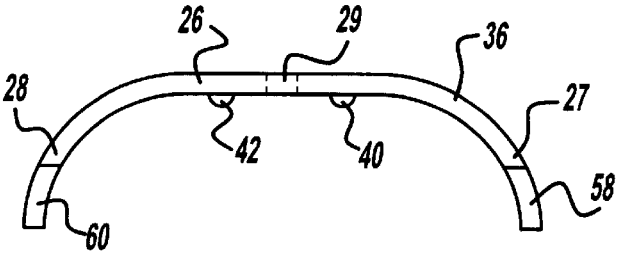
FIG. 6B is a side view of the fixed grapple of the present invention.
Figure 7:
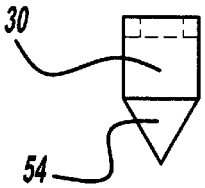
FIG. 7 is an end view of the movable grapple of the present invention.

Referring now to FIG. 4, there is shown shaft 12 in the preferred embodiment of a threaded eyebolt 52. Eyebolt 52 is manufactured from common steel and but may also be manufactured from a carbon steel or carbon reinforced plastic. Threaded portion 17 uses common threads but it is contemplated that any thread type that cooperates with nut 19 and end nut 50 is within the scope of the invention. Referring now to FIGS. 5, 6A and 7 there is shown movable grapple 30. Movable grapple 30 includes a pair of hook ends 54 and 56. Movable grapple 30 is manufactured from common steel and but may also be manufactured from a carbon steel or a carbon reinforced plastic. Referring now to FIG. 6B, there is shown fixed grapple 26. Fixed grapple 26 includes a pair of hook ends 58 and 60. Fixed grapple 26 is manufactured from common steel and but may also be manufactured from a carbon steel or a carbon reinforced plastic. Raised nubs 40 and 42 are in the preferred embodiment weld stubs that are raised approximately 0.05–20 millimeters from inner side 38. It is understood that the height of the raised nub will be directly related to rating of spring 20.

Figure 8:
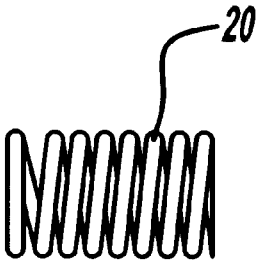
FIG. 8 is side view of the spring of the present invention.
Figure 9:
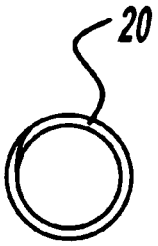
FIG. 9 is an end view of the spring of the present invention.
Figure 10A:
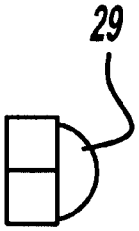
FIG. 10A is a side view of the end nut of the present invention.
Figure 10B:
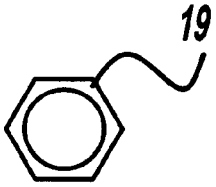
FIG. 10B is an end view of the end nut of the present invention.
Figure 11A:
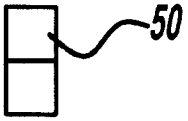
FIG. 11A is a side view of the nut of the present invention.
Figure 11B:
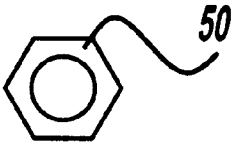
FIG. 11B is an end view of the nut of the present invention.

FIG. 8 illustrates spring 20. Spring 20, in the preferred embodiment is a flat spring having a rating in a range from 200 to 400 ft-lbs . It is understood that spring force of the spring 20 should calibrated according to the overall dimensions of the shaft 12, nut 19 placement along the shaft and force required to lock movable grapple 30 against fixed grapple 26. FIG. 10 illustrates the end nut 19 and FIG. 11 illustrates the nut 50.

Having described the structural characteristics of the present invention, attention is now turned to the advantageous operational characteristics derived therefrom. Referring to FIGS. 1 and 2, there is shown the collapsible grappling hook 10 with the movable grapple 30 slidably attached to shaft 12 between fixed grapple 26 and nut 19 and in the open position. In the open position the movable grapple 30 is generally perpendicular to the fixed grapple 26 such that spring 20 applies a sufficient force from second end 24 of the spring 20 to movable grapple 30 to lock the movable grapple 30 in the open position. Movable grapple

30, in the collapsed position shown in phantom in FIG. 2, the movable grapple 30 is moved approximately 90 degrees about the central axis 62 of the shaft 12. In such a collapsed position movable grapple 30 is generally parallel to fixed grapple 26.

As discussed above, when in the collapsed position the collapsible grappling hook is easily placed within the pants or coat pocket of the hunter for carrying to and from the tree stand and also when the hunter is climbing the tree stand. However, when the collapsible grappling hook is required such as when an article has inadvertently fallen to the ground or a bow or arrow must be raised, the hunter simply moves rotates the movable grapple 30 approximately 90 degrees about the axis 62 of the shaft 12. Referring back to FIGS. 1 and 2, collapsible grapple is now in the open position and ready for use by being lowered to the ground via a cord 63 attached to an attachment means for attaching the shaft 12 to the cord 63. The attachment means is preferably a loop end 66. Cord 63 is attached to collapsible grappling hook 10 at the loop end 66 and lowered to the ground to engage fallen articles. The hook end 54 and 56 of flukes 32 and 34 respectively and hook ends 58 and 60 of flukes 27 and 28 may engage the fallen articles which can then be raised to the tree stand. In also contemplated that a full 90 degree rotation is the preferred embodiment of the present invention but moving the grapple at least 45 degree will also develop a sufficient juxtaposition between the movable grapple 30 and fixed grapple 26 to create an sufficient engagement arrangement of the hook ends.

Raised nubs 40 and 42 assist in further locking movable grapple 30 in the open position. The spring 20 must be compressed momentarily to rotate the movable grapple in between the raised nubs 40 and 42. To move to a collapsed position, the spring 20 must again be compressed slightly to allow the movable grapple to travel over one of the raised nubs 40 or 42 depending on the direction of rotation. This requirement hinders movement and inadvertent collapse of the movable grapple into the collapsed position during any attempts to drop and engage the collapsible grappling hook with fallen articles. In addition nut 19 is adjustable along threaded portion 17 of shaft 12 such that the spring force applied to the movable grapple 30 is adjustable to fit the various dimensions of any manufactured collapsible grappling hook 10.

The best mode for carrying out the invention has been described in detail, those familiar with the art to which this invention relates will recognize various alternative designs and embodiments for practicing the invention as defined by the following claims.

What is claimed is:

1. A collapsible grappling hook comprising:

a shaft having a first end and a second end and a raised shoulder portion located between said first end and said second;

a spring having a first end and a second end, said spring attached to said shaft such that said first end contacts said raised shoulder portion;

a fixed grapple attached to said shaft, said fixed grapple having an outer side and an inner side, said inner side having a pair of spaced apart annular raised nubs extending out from said inner side, said fixed grapple also including at least one extending fluke; and a movable grapple slidably attached to said shaft between said fixed grapple and said raised shoulder, said movable grapple including at least one extending fluke, wherein said movable grapple is movable from a collapsed position such that said movable grapple is generally parallel to said fixed grapple to an open position such that said movable grapple is generally perpendicular to said fixed grapple and said movable grapple is located directly between said annular raised nubs whereby said spring applies a sufficient force from said second end of said spring to said movable grapple to lock said movable grapple in said open position.

2. The collapsible grappling hook of claim 1 wherein said raised shoulder is a nut and said first end of said shaft has a threaded portion to accept said nut.

3. The collapsible grappling hook of claim 2 wherein said nut is adjustable on said threaded portion of said shaft to allow for said force to be adjusted.

4. The collapsible grappling hook of claim 1 wherein said movable grapple includes a pair of oppositely extending flukes and each of said oppositely extending flukes having a hook end.

5. The collapsible grappling hook of claim 1 wherein said fixed grapple includes a pair of oppositely extending flukes and each of said oppositely extending flukes has a hook end.

6. The collapsible grappling hook of claim 1 wherein said shaft, movable grapple, and fixed grapple are manufactured from a carbon reinforced plastic.

* * * * *